US005525952A

United States Patent [19]

Rose

[11] Patent Number: 5,525,952

[45] Date of Patent: Jun. 11, 1996

[54] SWITCHBLADE

[75] Inventor: Derek J. Rose, Mansfield, Ohio

[73] Assignee: Therm-O-Disc, Incorporated, Mansfield, Ohio

[21] Appl. No.: 257,703

[22] Filed: Jun. 10, 1994

[51] Int. Cl.[6] ..... H01H 5/20; H01H 71/16; H01H 37/12; H01H 37/04

[52] U.S. Cl. ..... 337/60; 337/349; 337/372; 337/375; 200/407

[58] Field of Search ..... 337/9, 60, 363, 337/349, 372, 379, 375; 200/407

[56] References Cited

U.S. PATENT DOCUMENTS 3,852,695 12/1974 Northrup ..... 337/102
4,365,228 12/1982 Rowley ..... 337/347
4,816,794 3/1989 Nagao ..... 335/136
4,843,200 6/1989 Parlatore ..... 200/553
4,851,807 7/1989 Holden ..... 337/343
5,107,082 4/1992 Valenzona ..... 200/292

*Primary Examiner*—Leo P. Picard
*Assistant Examiner*—Stephen T. Ryan
*Attorney, Agent, or Firm*—Jones, Day, Reavis & Pogue

[57] ABSTRACT

A one-piece resilient switchblade includes contacts on its opposite end portions. A mounting arm extends transversely of the switchblade and is attached to a switchcase under bending stress for biasing the switchblade against a fulcrum. The mounting arm twists and the switchblade bows under influence of the force acting on the switchblade through the fulcrum. A movable bumper changes the fulcrum point to reverse the twist in the mounting arm and the bow in the switchblade.

14 Claims, 2 Drawing Sheets

SWITCHBLADE

BACKGROUND OF THE INVENTION

This application relates to the art of switches and, more particularly, to single pole, double throw switches. The invention is particularly applicable to a thermostatic switch having a bi-metal disc that snaps between opposite bowed positions for opening and closing switch contacts. However, it will be appreciated that the invention has broader aspects and can be used in other types of switches.

Single pole, double throw thermostatic switches commonly have a plurality of individual resilient switch arms, backup arms and a gap adjusting screw. It would be desirable to simplify such a switch by eliminating many of the individual parts.

SUMMARY OF THE INVENTION

A single pole, double throw thermostatic switch includes a single switchblade being a resilient mounting arm integral with a resilient switchblade. The mounting arm is both twisted and bent by a fulcrum in the switchcase and this, in turn, bends the switch arm for normally closing one pair of contacts while opening the other contact pair. A plunger operated by a snap disc shifts the fulcrum point to twist the mounting arm in an opposite direction and bend the switchblade in an opposite direction to open the one contact pair while closing the other contact pair.

It is a principal object of the present invention to provide an improved single pole, double throw thermostatic switch having a one-piece resilient switchblade that includes a resilient mounting arm integral with a switchblade.

It is another object of the invention to provide an improved one-piece switchblade for use in switches.

It is a further object of the invention to provide a single pole, double throw thermostatic switch that has a minimum number of parts, and is easy to manufacture and assemble.

DESCRIPTION OF PREFERRED EMBODIMENTS

Figure 1:
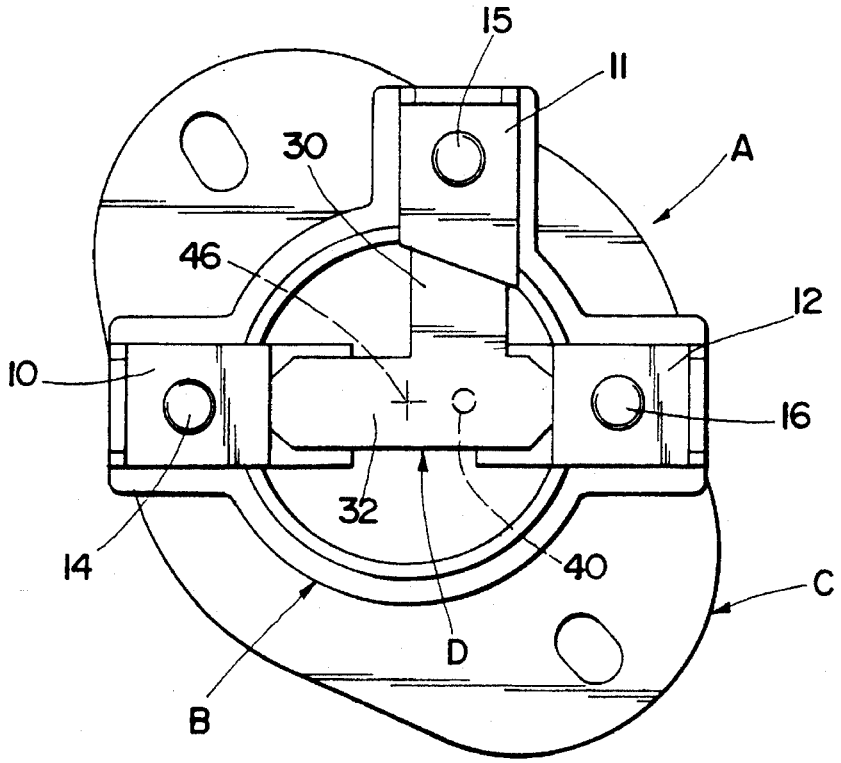
FIG. 1 is a top plan view of a single pole, double throw thermostatic switch constructed in accordance with the present application.

Referring now to the drawing, wherein the showings are for purposes of illustrating certain preferred embodiments of the invention only and not for purposes of limiting same, FIG. 1 shows a thermostat assembly A having a plastic switchcase B and a metal disc cup C. Terminals 10, 11, and 12 are attached to switchcase B by suitable fasteners such as rivets 14, 15, and 16.

Terminals 10 and 12 have fixed contacts 20, 22 located within switchcase B. Switchcase cover plate 24 in FIG. 2 is removed in FIG. 1 for viewing the interior of the switchcase and to show one-piece resilient switchplate D.

Switchplate D includes an elongated flat and resilient mounting arm 30 integral with a transversely extending resilient switchblade 32 carrying movable contacts 36, 38 on its opposite end portions. Arm 30 is secured to switchcase B by rivet 15 beneath terminal 11 at a securement location.

Figure 2:
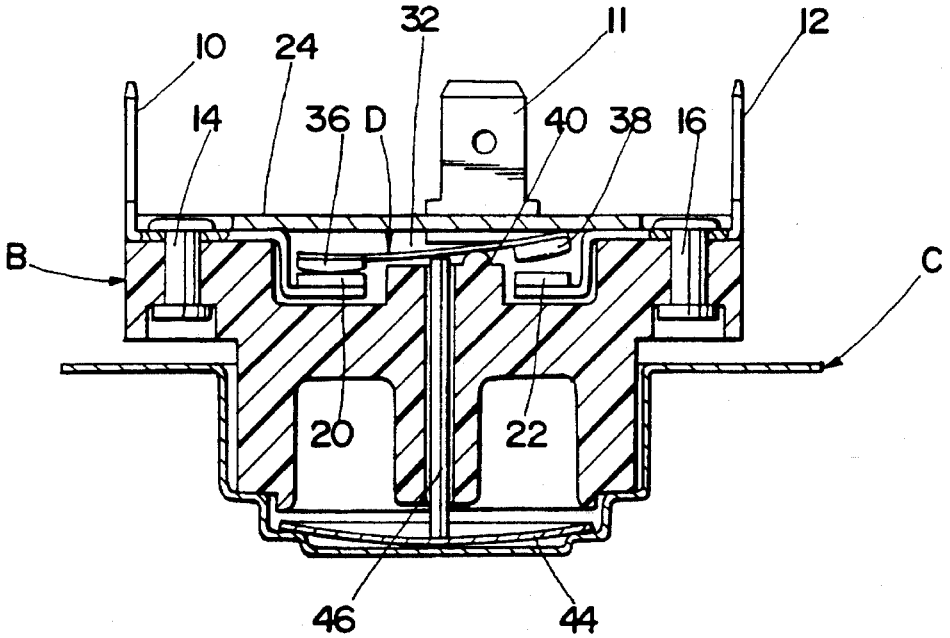
FIG. 2 is a cross-sectional elevational view thereof.

A fulcrum 40 within switchcase B is positioned for bending mounting arm 30 upwardly and also twisting same counterclockwise in FIG. 2 for bending switch arm 32 into the configuration shown in FIG. 2 with contacts 20, 36 closed and contacts 22, 38 open.

A bi-metal disc 44 within disc cup C cooperates with a reciprocating plunger 46. When a predetermined temperature is reached, bi-metal disc 44 snaps from the position shown in FIG. 2 to the reverse configuration shown in FIG. 3 to move plunger 46 upwardly. This changes the fulcrum point because the plunger 46 now becomes the fulcrum rather than fulcrum projection 40 on switchcase B. Shifting of the fulcrum point still bends mounting arm 30 upwardly but imparts a twist thereto in a clockwise direction for imparting a reverse bend to switchblade 32 which then assumes the configuration shown in FIG. 3 with contacts 20, 36 open and contacts 22, 38 closed.

Figure 3:
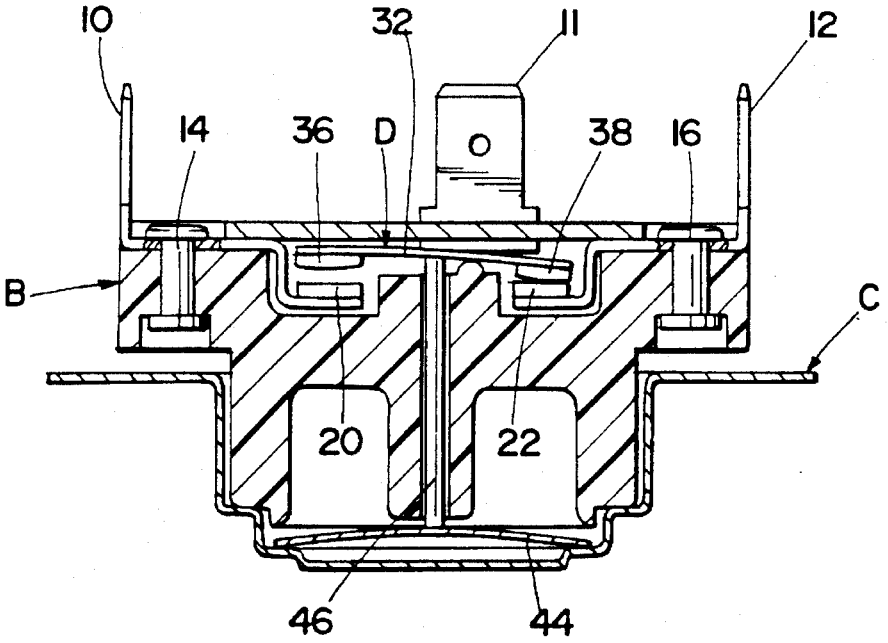
FIG. 3 is a view similar to FIG. 2 and showing the switchblade in its alternative operating position.
Figure 4:
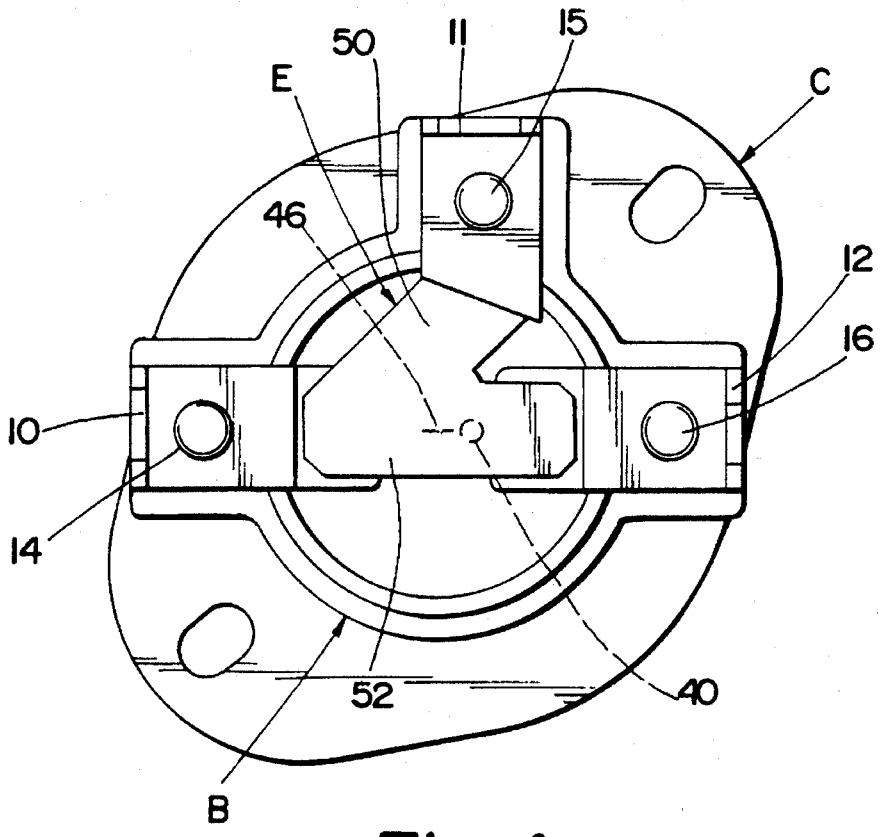
FIG. 4 is a top plan view similar to FIG. 1 and showing an alternative configuration for the switchblade.

FIG. 4 shows another arrangement for the one-piece switchplate. The switchcase cover plate is removed in FIG. 4 to show switchplate E having a flat and resilient mounting arm 50 extending at an acute angle to a flat and resilient switchblade 52 rather than substantially perpendicular thereto as in the arrangement of FIGS. 1–3. Switchcase fulcrum point 40 is indicated in FIG. 4 as is the fulcrum point provided by plunger 46. The arrangement of FIG. 4 works in the same manner as described with respect to the embodiment of FIGS. 1–3. Obviously, many other shapes may be provided for the one-piece switchplate. The important considerations are that the mounting arm be upwardly stressed and twisted in one direction when it is assembled, and that the same upward bending but reverse twist be provided by shifting the fulcrum point to the plunger when the bi-metal disc reverses position.

In the arrangement of FIGS. 1–3, mounting arm 30 is integrally connected with switchblade 32 intermediate the opposite ends of switchblade 32. In the preferred arrangement, mounting arm 30 is located substantially closer to one end of switchblade 32 than the other end thereof. The embodiment of FIGS. 1–3 has mounting arm 30 extending substantially perpendicular to switchblade 32 while in the arrangement of FIG. 4 mounting arm 50 extends from switchblade 52 at an angle substantially less than 90°.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the claims.

I claim:

1. A substantially flat resilient one-piece switchplate having an elongated switchblade with opposite end portions, electrical contacts on said opposite end portions, said switchplate having a mounting arm integral with said switchblade and extending transversely thereof in the same plane as said switchblade, said mounting arm being connected with said switchblade substantially closer to one of said switchblade end portions than to the other of said switchblade end portions, said arm being resiliently bendable and twistable for biasing said blade against a fulcrum and bowing said blade responsive to force acting on the blade at the fulcrum.

2. The switchplate of claim 1 wherein said switchblade has a flat surface on one side thereof and said pair of electrical contacts are attached to said flat surface at said opposite end portions of said switchblade.

3. The switchblade of claim 1 wherein said arm is connected with said blade adjacent one of said end portions of said blade.

4. The switchblade of claim 1 wherein said arm extends substantially perpendicular to said blade.

5. The switchblade of claim 1 wherein said arm extends from said blade at an angle substantially different than 90°.

6. A switch including a switchcase having a raised fulcrum and a pair of fixed electrical contacts on opposite sides of said fulcrum, a substantially flat resilient switchblade with opposite ends and opposite end portions, a pair of movable electrical contacts on said end portions of said switchblade for cooperation with said fixed contacts, said switchblade having an integral mounting arm extending transversely of said switchblade and being secured to said switchcase at a securement location, said mounting arm being both resiliently bent and resiliently twisted under resilient bending and twisting stress between said securement location and said fulcrum, said switchblade being biased into engagement with said fulcrum by said bending and twisting stress in said mounting arm, said switchblade being resiliently bowed and in bowing stress by engagement thereof with said fulcrum under said bending and twisting stress in said mounting arm, said switchblade in said resiliently bowed condition providing engagement between one of said movable and fixed contacts to define a pair of closed contacts while maintaining separation of the other of said fixed and movable contacts to define a pair of open contacts.

7. The switch of claim 6 including a movable bumper for engaging said blade on the same side thereof as said fulcrum and for imparting a force to said blade in a direction tending to lift said blade from said fulcrum, said bumper being engageable with said blade at a location spaced from said fulcrum toward said closed contacts, said bumper being operable to impart force to said blade for reversing the direction of twisting stress in said mounting arm and the bowed direction of said switchblade for opening said closed contacts and closing said open contacts.

8. The switch of claim 7 wherein said bumper is operative to reverse the bowed direction of said switchblade.

9. The switch of claim 7 including a thermostatic disc cooperating with said bumper for imparting force thereto to reverse the closed and open positions of said fixed and movable contacts.

10. The switch of claim 6 wherein said mounting arm is connected with said blade intermediate said opposite ends of said blade.

11. The switch of claim 10 wherein said arm is connected with said blade closely adjacent one of said blade ends.

12. The switch of claim 10 wherein said arm is substantially perpendicular to said blade.

13. The switch of claim 6 wherein said arm is connected with said blade at one of said end portions thereof.

14. A switch including a switchcase having a fixed fulcrum and a pair of fixed contacts on opposite sides of said fulcrum, a one-piece substantially flat resiliently bendable switchplate having a switchblade and a mounting arm extending transversely of said switchblade, said mounting arm being secured to said switchcase at a securement location and being under resilient bending and twisting stress between said securement location and said fulcrum, said switchblade having a pair of movable contacts and being biased into engagement with said fulcrum by said bending and twisting stress in said mounting arm, said switchblade being resiliently bowed and in bowing stress by virtue of engagement thereof with said fulcrum under biasing force provided by said bending and twisting stress in said mounting arm, said bowed switchblade providing engagement between one of said fixed and movable contacts to define a pair of closed contacts and to separate the other of said fixed and movable contacts to define a pair of open contacts, and a movable fulcrum spaced from said fixed fulcrum for engaging said switchblade to reverse the direction of twisting stress in said mounting arm and the direction of bowing of said switchblade to open said pair of closed contacts and close said pair of open contacts.

* * * * *